United States Patent [19]

Nagano

[11] 4,330,348

[45] May 18, 1982

[54] METHOD FOR HEATING CONTINUOUSLY CAST STEEL SLAB FOR PRODUCTION OF GRAIN-ORIENTED SILICON STEEL SHEET HAVING HIGH MAGNETIC FLUX DENSITY

[75] Inventor: Takashi Nagano, Kitakyusyushi, Japan

[73] Assignee: Nippon Steel Corporation, Tokyo, Japan

[21] Appl. No.: 213,731

[22] Filed: Dec. 5, 1980

[30] Foreign Application Priority Data

Dec. 13, 1979 [JP] Japan ..... 54-161916

[51] Int. Cl.[3] ..... H01F 1/04

[52] U.S. Cl. ..... 148/111; 148/112; 148/31.55

[58] Field of Search ..... 148/110, 111, 112, 113, 148/31.5, 31.55

[56] References Cited

U.S. PATENT DOCUMENTS

| | | | |
|---|---|---|---|
| 3,770,517 | 11/1973 | Gray et al. | 148/112 |
| 3,802,937 | 4/1974 | Kohler et al. | 148/112 |
| 4,014,717 | 3/1977 | Barisoni et al. | 148/111 |
| 4,088,513 | 5/1978 | Nakazawa et al. | 148/112 |

*Primary Examiner*—L. Dewayne Rutledge
*Assistant Examiner*—John P. Sheehan
*Attorney, Agent, or Firm*—Wenderoth, Lind & Ponack

[57] ABSTRACT

A method for heating in a pusher-type furnace a continuously cast steel slab for production of a high magnetic flux density, grain-oriented silicon steel sheet, which comprises holding the portion of the slab having the lowest temperature during the heating at 1300° C. or higher for 30 minutes or longer, so that the final temperature of that portion reaches 1330° C. or higher.

6 Claims, 5 Drawing Figures

—⊙ Temperature and time at the extraction from the heating furnace

--- Extrapolated line for slab held under the same heating condition (○ Secondary recrystallization ratio in the final product 97~100%
● Secondary recrystallization ratio in the final product 0 ~ 96%)

(○ Secondary recrystallization ratio in the final product 97 ~ 100%
● Secondary recrystallization ratio in the final product 0 ~ 96%)

METHOD FOR HEATING CONTINUOUSLY CAST STEEL SLAB FOR PRODUCTION OF GRAIN-ORIENTED SILICON STEEL SHEET HAVING HIGH MAGNETIC FLUX DENSITY

BACKGROUND OF THE INVENTION

1. Field of the Invention

The present invention relates to a method for heating continuously cast steel slab for production of grain-oriented silicon steel sheet having a grain orientation in the (110) direction as identified by the Miller index and a high magnetic flux density.

2. Description of the Prior Art

In the production of a grain-oriented steel sheet by the steps of slab heating, hot rolling, cold rolling, decarburization and finishing annealing, an indispensable factor in obtaining a secondary recrystallization structure having (110) grain orientation during the finishing annealing step is the existence within the steel structure of a secondary dispersion phase. For this reason, it is necessary for the secondary dispersion phase forming substances such as MnS, AlN and the like to be completely dissolved in solid solution in the matrix in the slab heating step, and then for these secondary dispersion phase forming substances to be finely dispersed in the steel in the hot rolling step.

In order to completely dissolve the secondary dispersion phase forming substances in solid solution during the slab heating step, it is necessary to control the slab heating temperature in a pusher-type or walking-beam type furnace, for example.

In this temperature control, it is important from the point of uniformly heating the slab to properly control the temperature history (temperature vs time) of the portion of the slab which is heated to the lowest temperature (lowest temperature portion).

In the case where the steel slab is heated in a walking-beam type furnace, the contact position between the furnace skids and the lower surface of the slab changes as the slab is transferred through the furnace so that there is no substantial temperature difference between the front side and the back side of the slab and the lowest temperature portion of the slab exists near the center of the slab. Therefore, the temperature of the lowest temperature portion of the slab can be easily controlled by controlling the surface temperature.

On the other hand, when the slab is heated in a pusher-type furnace, the lowest temperature portion of the slab is at or near that part of the lower surface of the slab which is in contact with the furnace skids. It is, however, difficult to directly determine the temperature history of the lowest temperature portion in the pusher-type heating furnace because of structural factors (namely, because the soaking zone has a brick hearth, a dry skid hearth, etc.) and because the lowest temperature portion is always in contact with the furnace skids.

Therefore, slab heating in a pusher-type furnace has conventionally been performed without direct knowledge of the temperature history of the lowest temperature portion of the slab, and the temperature at which such conventional slab heating is to be carried out is determined by such factors as slab surface temperature, the furnace atmosphere temperature, the residence time of the slab in the furnace, the slab extraction pitch, the slab surface temperature after extraction from the furnace and the driving power required in rolling the slab.

In recent years, continuous casting has been widely adopted for production of various grades of steel, and steel slabs for production of grain-oriented silicon steel sheet have also been produced more and more by continuous casting.

Contrary to steel slabs prepared by break-down rolling, continuously cast slabs have an as-cast structure. As a consequence, grain-oriented silicon steel sheet produced from continuously cast slabs has frequently suffered from insufficient secondary recrystallization because of the incomplete dissolution in solid solution of the secondary dispersion phase forming substances into the matrix, and from poor magnetic properties because of abnormal grain growth caused by excessive slab heating.

In spite of the above-mentioned problems peculiar to the heating of continuously cast steel slabs, conventional art methods of heating continuously cast slabs in the pusher-type heating furnace give no consideration to the temperature history of the lowest temperature portion of the slab, namely that part remaining constantly in contact with the furnace skid. Thus, as this lowest temperature portion is more difficult to fully heat than the other portions, it suffers from insufficient dissolution into solid solution of the secondary dispersion phase forming substances such as MnS and AlN in the matrix. As a consequence, secondary recrystallization does not fully develop in the final finishing annealing of the steel sheet made from the slab, and the result is nonuniformity of such magnetic properties as magnetic flux density and iron core loss of the final product.

On the other hand, any attempt to avoid poor secondary recrystallization by raising the temperature of the lowest temperature portion of the slab through control of the conventional factors mentioned above is not likely to be successful since, as mentioned earlier, the continuously cast slab is susceptible to abnormal grain growth so that such abnormal grain growth is apt to occur in portions other than the lowest temperature portion, thus degrading and/or causing nonuniformity in the magnetic properties.

As mentioned above, the conventional method used for slab heating in pusher-type heating furnaces entails problems in that it is apt to cause deterioration and/or nonuniformity in the magnetic properties of the resultant high magnetic flux density, grain-oriented silicon steel sheets.

SUMMARY OF THE INVENTION

Therefore, the principal object of the present invention is to provide a method for heating continuously cast steel slabs which can completely eliminate the problems entailed by the conventional slab heating in the pusher-type furnace.

According to the present invention, the secondary dispersion phase forming substances can be dissolved into solid solution in the matrix even in the lowest temperature portion of the continuously cast slab, while abnormal grain growth in the portions other than the lowest temperature portion can be effectively prevented.

The gist of the present invention lies in a method of heating a continuously cast steel slab for production of grain-oriented silicon steel sheets having high magnetic flux density in a slab heating furnace, characterized in that a continuously cast steel slab containing not more than 0.085% C, 2.0 to 4.0% Si, not more than 0.15% Mn, and 0.010 to 0.065% acid soluble Al is heated in such a manner that the lowest temperature portion of the slab is held at a temperature not less than 1300° C. for a period not shorter than 30 minutes, the temperature of said portion at the end of said period being not less than 1330° C.

DETAILED DESCRIPTION OF THE INVENTION

The composition of the continuously cast steel slab used in the present invention is limited to the above ranges for the following reasons.

With carbon contents exceeding 0.085%, it is completely impossible to obtain a silicon steel sheet having a high magnetic flux density regardless of what other elements are added.

Steels with less than 2% silicon content are insufficient in magnetic properties and those with more than 4% silicon are difficult to cold roll. Manganese and aluminum are both essential elements for obtaining a high magnetic flux density. If the content of these elements is outside the ranges defined above, the development of the secondary recrystallization is incomplete, and it is impossible to obtain a silicon steel sheet having a low iron core loss and a high magnetic flux density.

Continuously cast slabs having the above defined chemical composition may be obtained by continuously casting molten steel refined by an ordinary method, or molten steel obtained by secondary refinement.

According to the present invention, the continuously cast slab is heated in a pusher-type furnace in such a manner that the portion of the slab which has the lowest temperature, namely the portion of the lower surface at and in the vicinity of the area where the slab is in contact with the furnace skids, is held at a temperature not less than 1300° C. for a period not shorter than 30 minutes, the temperature of such portion at the end of said period being 1330° C. or higher. More preferably, the lowest temperature portion is held within the temperature range of from 1300° C. to 1380° C. for 30 minutes or longer so as to be finally heated to a temperature of from 1330° C. to 1380° C.

When the continuously cast slab is heated according to the present invention, it is necessary to restrict the upper limit of the temperature of the lowest temperature portion to a maximum of 1380° C. in order to prevent the development of abnormal grain growth in the other higher temperature portions.

Moreover, the magnetic properties of the final product are influenced by the grain structure of the slab after heating. The present inventors have found that when the proportion of the coarse grains in the heat treated continuously cast slab is 40% or higher, preferably 50 to 80%, with respect to the cross section of the slab, it is possible to obtain a silicon steel sheet having an iron core loss not larger than W17/50=1.08 W/kg and having an excellent magnetic flux density.

Figure 5:
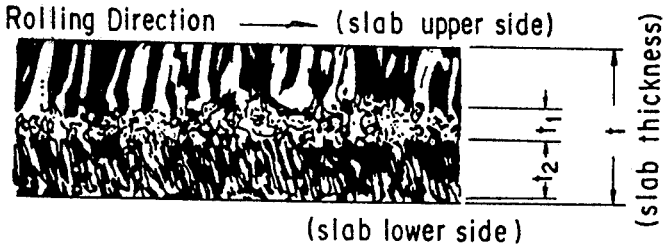
FIG. 5 explains the definition of the coarse grain ratio in the continuously cast steel slab.

As shown in FIG. 5, the proportion of the coarse grains is defined by the following formula:

$$\text{Coarse grain ratio} = \frac{t - (t_1 + t_2)}{t} \times 100$$

in which t represents the slab thickness, $t_1$ represents the thickness of the equiaxed grains which has not been changed by the slab heating and $t_2$ represents the thickness of the columnar grains which has not been changed by the slab heating, and $t-(t_1+t_2)$ represents the increase in thickness in the coarse grain structure resulting from the slab heating.

For measurement of the temperature of the lowest temperature portion of the slab in the pusher-type furnace, a sheath thermocouple is imbedded in the lowest temperature portion of the slab, namely the portion in contact with the furnace skids, so as to continuously measure the temperature. The portion of the sheath thermocouple exposed outside of the slab is protected by a stainless steel tube and is cooled by gas so as to improve the measurement accuracy. However, the temperature measurement can be performed by other methods, and it is not necessary to measure the temperature of the lowest temperature portion of every slab. When slabs of the same weight and same thickness are heated, only the first slab need be subjected to the temperature measurement, while the subsequent slabs can be heated under the same heating condition as that determined in accordance with the temperature measurement of the first slab.

The slab heated under the above described conditions is free from abnormal grain growth, and the secondary dispersion phase forming substances therein are dissolved in solid solution in the matrix. Therefore, when the slab is hot rolled, then at least once cold rolled and annealed, and subsequently subjected to final finishing annealing, the resultant sheet product has fully developed secondary recrystallization. In this way, a grain-oriented silicon steel sheet having a high magnetic flux density and a low iron core loss can be consistently produced.

The heating method for a continuously cast steel slab in a pusher-type furnace according to the present invention will be better understood from the examples set forth below with reference to the attached drawings.

EXAMPLE 1

Molten steel containing 0.055% C, 2.94% Si, 0.072% Mn and 0.031% sol. Al and a balance of Fe was prepared in a converter, subjected to vacuum degassing treatment, and continuously cast into slabs 200 mm in thickness.

Prior to heating these slabs in a pusher-type furnace, a CA Inconel sheath thermocouple 4.8 mm in diameter was imbedded in the lowest temperature portion of each slab. These slabs for temperature measurement were placed in a three-zone pusher type heating furnace, and their lowest temperature portions were heated according to the different heating patterns shown in FIG. 1 as I, II, III and IV. The temperatures of the lowest temperature portions were monitored throughout the heating process.

The portions of the thermocouples exposed outside of the slabs were subjected to air purging as the temperatures of the lowest temperature portions were measured continuously. The coarse grain ratios of these heat treated slabs are shown in Table 1.

Simultaneously with the heating of the steel slabs for temperature measurement, steel slabs prepared from the same heats were charged in the furnace and heated adjacent to the slabs for temperature measurement. These slabs were hot rolled into 2.3 mm thick sheets, annealed at 1120° C. for two minutes, and then after acid pickling, cold rolled into 0.30 mm thick cold rolled steel sheets. These cold rolled sheets were subjected to decarburization annealing, and then to a final finishing annealing. The magnetic properties and the ratios of secondary recrystallization of the resultant silicon steel sheets are shown in Table 1.

TABLE 1

| Heating Conditions | I | II | III | IV |
|---|---|---|---|---|
| Holding time at 1300° C. or higher (min.) | 55 | 38 | 27 | 7 |
| Holding time at 1330° C. or higher (min.) | 25 | 7 | 0 | 0 |
| Coarse grain ratio (%) | 80 | 65 | 35 | 15 |
| Ratio of secondary recrystallization* | 5/5 | 4/4 | 3/6 | 1/6 |
| Iron core loss W17/50 (Watt/kg) | $\bar{x}$ = 1.050 | 1.040 | 1.094 | 1.216 |
| Magnetic flux-density $B_{10}$ ($Wb/m^2$) | $\bar{x}$ = 1.947 | 1.948 | 1.931 | 1.897 |

*Secondary recrystallization ratio = $\frac{\text{Number of coils in which 97\% or higher secondary recrystallization is attained}}{\text{Total number of coils}}$

EXAMPLE 2

A molten steel containing 0.050% C, 2.98% Si, 0.083% Mn, 0.027% sol. Al, with the balance being iron and unavoidable impurities was prepared in a converter, subjected to vacuum degassing treatment, and continuously cast into slabs 200 mm in thickness. In some of these slabs, thermocouples were imbedded in a similar way as in Example 1 to prepare slabs for temperature measurement. These slabs were charged in a three-zone pusher-type furnace adjacent to slabs prepared from the same heat but not imbedded with thermocouples, and the lowest temperature portions of these slabs were heated according to the heating patterns V and VI shown in FIG. 1. The temperature histories of the lowest temperature portions and the coarse grain ratios in the heat treated slabs are shown in Table 2.

The slabs which were heated under the same conditions as the slabs for temperature measurement were hot rolled, cold rolled, and subjected to decarburization annealing and final finishing annealing as in Example 1. The secondary recrystallization ratios and the magnetic properties of the resultant silicon steel sheets are shown in Table 2.

TABLE 2

| Heating Conditions | V | VI |
|---|---|---|
| Holding time at 1300° C. or higher(min.) | 48 | 28 |
| Holding time at 1330° C. or higher(min.) | 25 | 0 |
| Coarse grain ratio (%) | 75 | 25 |
| Ratio of secondary recrystallization | 7/7 | 0/2 |
| Iron core loss W17/50 (Watt/kg) | $\bar{x}$ = 1.046 | 1.161 |

TABLE 2-continued

| Heating Conditions | V | VI |
|---|---|---|
| Magnetic flux-density $B_{10}$ ($Wb/m^2$) | $\bar{x}$ = 1.946 | 1.913 |

Figure 2:
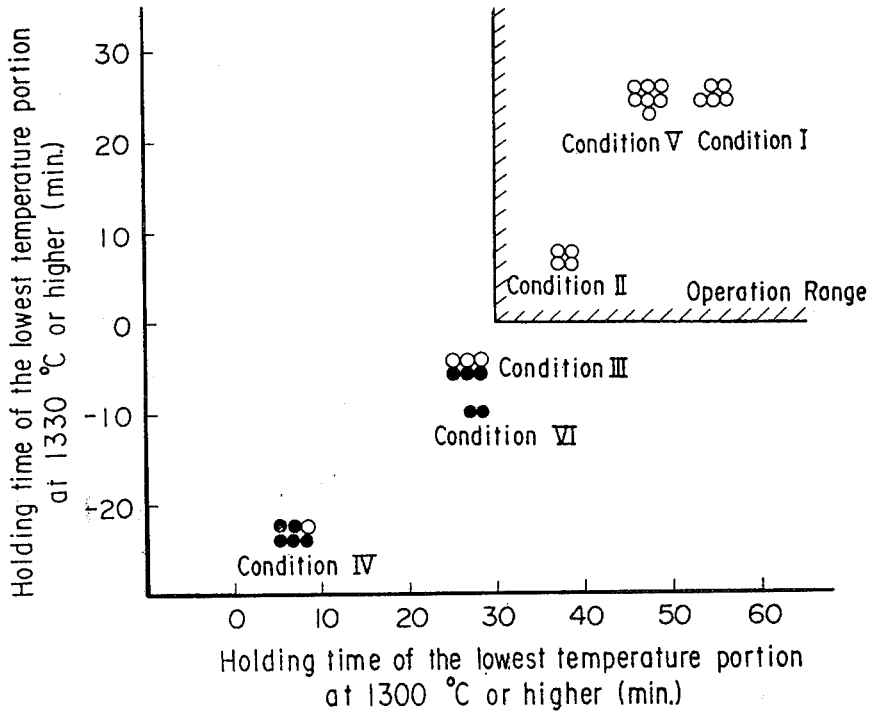
FIG. 2 shows the relation between the lowest temperature portion of the continuously cast steel slab and the secondary recrystallization ratio in the final product.

On the basis of the results of the foregoing two examples, the relation between the heating temperature history of the lowest temperature portion of the continuously cast slabs and the secondary recrystallization ratio in the final silicon steel sheets produced from the slabs was determined and is shown in FIG. 2.

Figure 1:
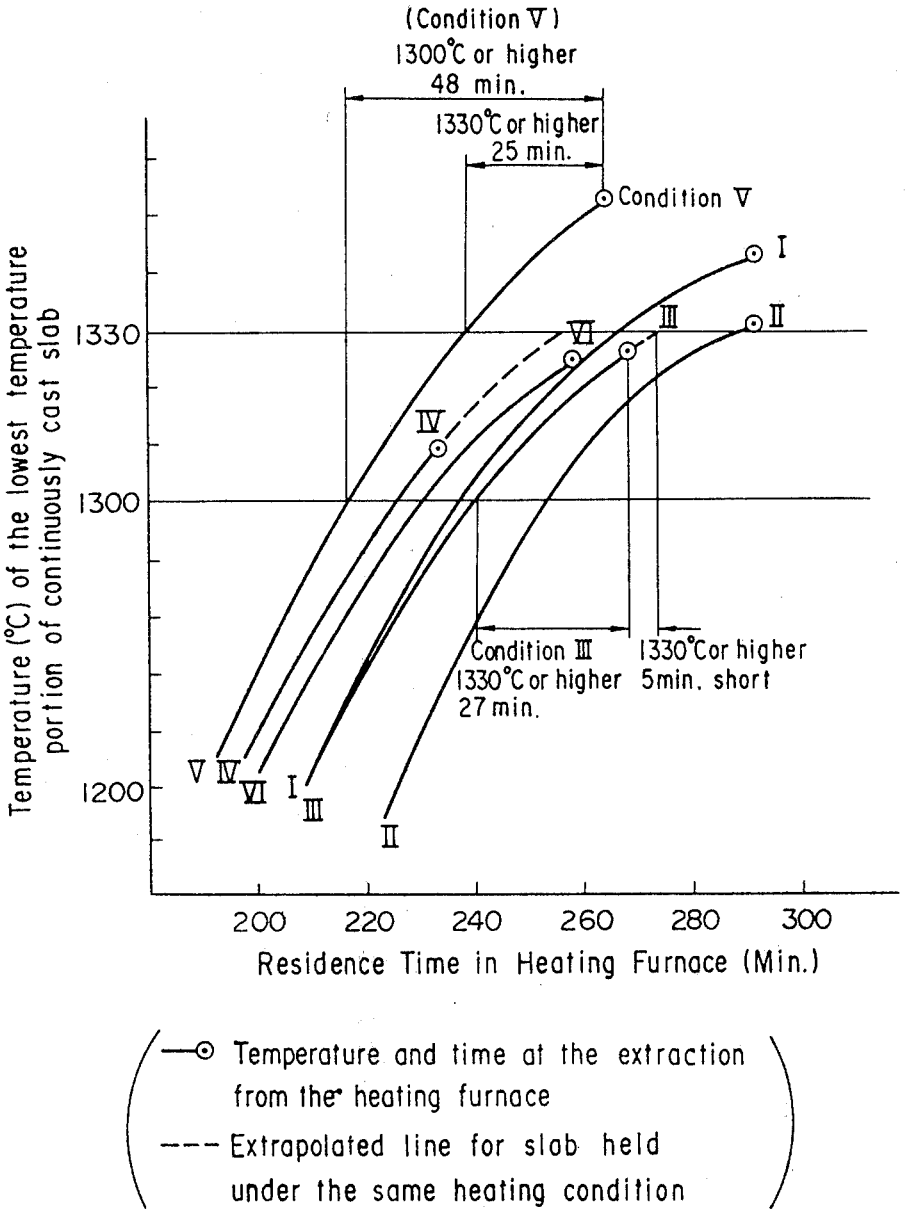
FIG. 1 shows the heating pattern of the lowest temperature portion of the continuously cast steel slab.

As clearly understood from FIG. 2, in order to obtain final silicon steel sheets with good secondary recrystallization (those indicated by o in the figure and having 100–97% secondary recrystallization), it is necessary to apply one of the slab heating conditions, I, II or V in FIG. 1, namely, to hold the lowest temperature portion of the slab at 1300° C. or higher for 30 minutes or longer, with the final temperature of this portion reaching 1330° C. or higher.

In the cases of the heating conditions III, IV and VI, which are outside the conditions defined by this invention, the secondary recrystallization ratio in the final silicon steel sheets is not satisfactory (those indicated by • in the figure and having 0–96% secondary recrystallization) and the resultant magnetic properties are poor. That is to say, the favorable results of this invention cannot be obtained merely by holding the lowest temperature portion of the slab in the temperature range between 1300° C. and 1330° C.

The presumed reason for this is that the heat energy in the lowest temperature portion of the slab is not sufficient for the solid dissolution in the matrix of the secondary dispersion phase forming substances, for example, MnS and AlN.

Even when the lowest temperature portion of the slab is held in the temperature range from 1300° C. to not more than 1330° C. for 30 minutes or longer, the development of the secondary recrystallization in the final product is not satisfactory so that excellent magnetic properties can not be obtained.

Figure 3:
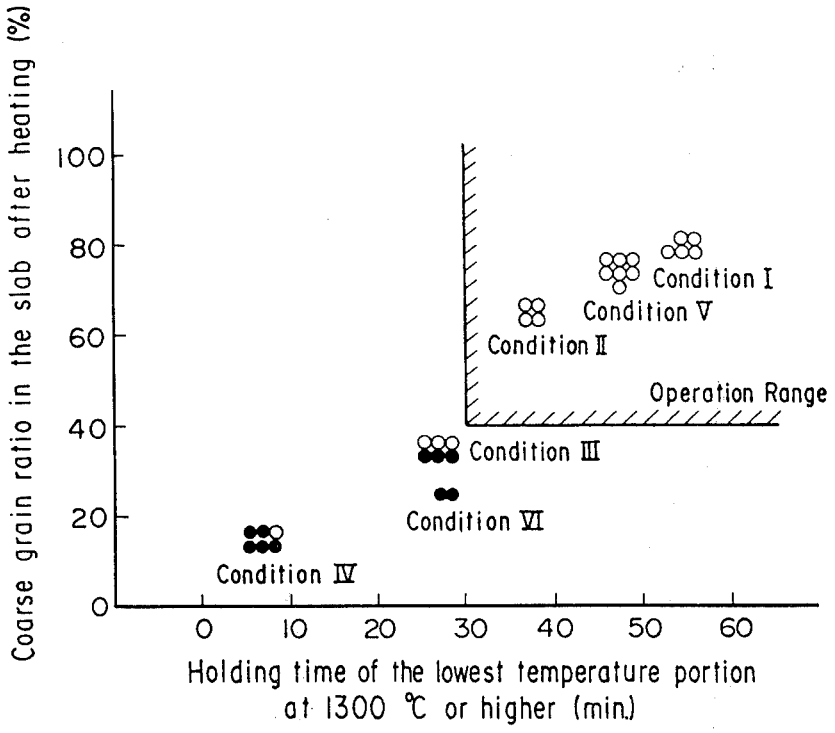
FIG. 3 shows the relation between the time that the lowest temperature portion is held at a temperature not less than 1300° C. and the proportion of the coarse grains in the continuously cast slab after the heating.

As clearly understood from FIG. 3 showing the relation between the heating temperature history of the lowest temperature portion of the slab and the coarse grain ratio in the heated slab, in order to obtain a coarse grain ratio of 40% or more with respect to the slab cross section, it is necessary to heat the slab according to the minimum slab heating temperature conditions I, II or V as explained in connection with FIG. 1. That is to say, it is necessary that the lowest temperature portion be held at 1300° C. or higher for 30 minutes or longer and for its final temperature to reach 1330° C. or higher.

Figure 4:
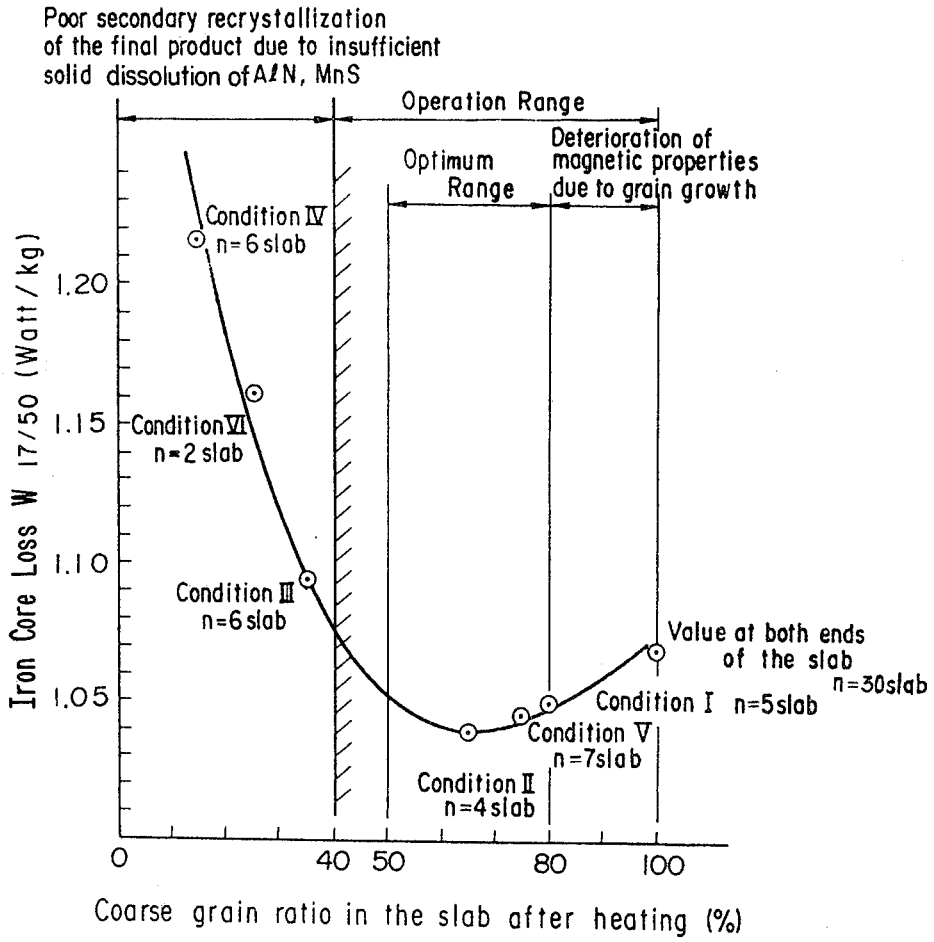
FIG. 4 shows the relation between the proportion of the coarse grains in the steel slab after the heating and the iron core loss of the final product.

As clearly understood from FIG. 4 showing the relation between the coarse grain ratio in the slab after heating and the iron core loss W17/50 of the final silicon steel sheet, the iron core loss of the silicon steel sheets produced from the slabs whose lowest temperature portions have been heated according to the heating conditions I, II or V (and whose coarse grain ratios are 40–80%) is far better than that of the final silicon steel sheet produced from the slabs whose lowest temperature portions have been heated according to the slab heating conditions III, IV or VI (and whose coarse grain ratios are less than 40%), that is, according to slab heating conditions outside the scope of the present invention.

As also understood from FIG. 4, when the coarse grain ratio exceeds 80%, the resultant magnetic properties tend to deteriorate.

As described above, the present invention can completely eliminate the difficulties encountered in carrying out the conventional method of heating continuously cast slabs in a pusher-type heating furnace, and moreover, has the remarkable advantage that it makes it possible to control the coarse grain ratio in the heated slab so that improved and uniform magnetic properties can be obtained in the final products.

What is claimed is:

1. A method for heating a continuously cast steel slab for production of a grain-oriented silicon steel sheet having high magnetic flux density in a slab heating furnace, comprising heating a continuously cast slab containing not more than 0.085% C, 2.0 to 4.0% Si, not more than 0.15% Mn and 0.010 to 0.065% sol. Al in such a manner that the lowest temperature portion of the slab is held at a temperature of at least 1300° C. for a period of time of at least 30 minutes, and said portion of the slab is finally heated to a temperature of at least 1330° C.

2. A method according to claim 1, wherein the lowest temperature portion of the slab is held within the temperature range of from 1300° to 1380° C. for 30 minutes or longer so as to be finally heated to a temperature of from 1330° to 1380° C.

3. A method according to claim 1 or 2, wherein the lowest temperature portion of the slab is the portion of the lower surface of the slab at and in the vicinity of the area where the slab is in contact with the furnace skids.

4. A method according to claim 1 or 2, wherein the heating is performed so as to obtain a coarse grain ratio in the cross section of the slab of from 40 to 80%.

5. A method according to claim 1 or 2, wherein the furnace is a pusher-type heating furnace.

6. In a method for producing a grain-oriented silicon steel sheet having high magnetic flux density, comprising heating a continuously cast steel slab containing not more than 0.085% C, 2.0 to 4.0% Si, not more than 0.15% Mn and 0.010 to 0.065% sol. Al, and subjecting the heated slab to hot rolling, cold rolling, decarburization annealing and finishing annealing, the improvement wherein said heating of said continuously cast steel slab is such that the lowest temperature portion of said slab is held at a temperature of at least 1300° C. for at least 30 minutes and the final temperature of said portion of said slab is at least 1330° C.

* * * * *